US006508644B1

(12) United States Patent
Pesu et al.

(10) Patent No.: US 6,508,644 B1
(45) Date of Patent: Jan. 21, 2003

(54) FLAME-RESISTANT WICK HOLDER FOR CANDLE

(75) Inventors: Bradley D. Pesu, Gahanna, OH (US); Joseph P. Romano, Worthington, OH (US)

(73) Assignee: Bath & Body Works, Inc., Reynoldsburg, OH (US)

( * ) Notice: Subject to any disclaimer, the term of this patent is extended or adjusted under 35 U.S.C. 154(b) by 0 days.

(21) Appl. No.: 09/931,826

(22) Filed: Aug. 17, 2001

(51) Int. Cl.[7] ..... F21V 35/00; C11C 5/00; F23D 3/16

(52) U.S. Cl. ..... 431/35; 431/288; 431/289; 431/325; 431/291; 431/33

(58) Field of Search ..... 431/21, 33, 35, 431/288, 289, 291, 75, 325, 297, 315, 188, 189, 191, 320; 137/78.5, 65, 75, 68.11, 68.12, 72, 74

(56) References Cited

U.S. PATENT DOCUMENTS

| | | | | |
|---|---|---|---|---|
| 343,567 | A | * | 6/1886 | Clarke |
| 803,848 | A | | 11/1905 | Pereira |
| 2,831,330 | A | | 4/1958 | Walker |
| 3,574,644 | A | * | 4/1971 | Olstowski et al. |
| 3,582,251 | A | | 6/1971 | Concannon |
| 3,652,197 | A | | 3/1972 | Tokarz |
| 3,797,990 | A | | 3/1974 | Rogers et al. |
| 3,819,342 | A | | 6/1974 | Gunderman et al. |
| 3,940,233 | A | | 2/1976 | Fox et al. |
| 4,332,548 | A | | 6/1982 | Linton et al. |
| 4,818,214 | A | * | 4/1989 | Ronnback |
| 5,127,922 | A | | 7/1992 | Bension |
| 5,155,957 | A | * | 10/1992 | Robertson et al. |
| 5,256,059 | A | | 10/1993 | Knippenberg |
| 5,681,640 | A | | 10/1997 | Kiser |
| 5,842,850 | A | | 12/1998 | Pappas |
| 5,927,312 | A | * | 7/1999 | Dryden et al. |
| 5,927,965 | A | | 7/1999 | Pappas |

FOREIGN PATENT DOCUMENTS

| | | | | |
|---|---|---|---|---|
| DE | 64854 | * | 10/1892 | 431/288 |
| DE | 2 246 464 | * | 4/1974 | 431/35 |
| DE | 2415652 | * | 10/1975 | 431/35 |
| DE | 28 50 353 | * | 5/1980 | 431/35 |
| DE | 36 30 712 | * | 3/1986 | 431/325 |
| FR | 1 423 888 | * | 11/1964 | 431/35 |
| WO | WO 92/13052 | * | 8/1992 | 431/35 |
| WO | WO 97/30138 | * | 8/1997 | 431/35 |

OTHER PUBLICATIONS

Boedeker Plastics, Inc. UL 94 Overview Dec. 6, 2000.
BP Amoco Polymers, Radel® Resins Engineering Data, Mar. 2000 content, pp. 1–7, 26.
BP AMOCO "Play to Win: The right resin keeps you in the game." Oct. 1999.

* cited by examiner

*Primary Examiner*—Carl D. Price
(74) *Attorney, Agent, or Firm*—Colucci & Umans; Peter C. Michalos; Angelo Notaro

(57) ABSTRACT

A flame-retardant wick holder for a candle is made of a plastic having a UL-94 vertical burn test rating of at least V-0. The wick holder has a bore for holding a wick at the bottom of a candle. The wick holder is provided so that when the candle and wick burn down to the level of the wick holder, the material of the wick holder causes the flame on the wick to extinguish, thereby preventing flashover of the residual candle fuel at the end of the candle useful life. The wick holder is preferably made of a polyethersulfone (PES).

11 Claims, 6 Drawing Sheets

FLAME-RESISTANT WICK HOLDER FOR CANDLE

FIELD AND BACKGROUND OF THE INVENTION

The present invention relates generally to the field of candle making and in particular to a new and useful holder for a wick which extinguishes the candle flame and inhibits combustion of residual candle fuel in a container for the candle at the end of the candle useful life.

Candle wicks function by capillary action drawing a fuel from a pool up through the wick to the flame. The fuel used in known candles may be paraffin wax, vegetable-based wax or synthetic polymers, like ester-terminated polyamides (ETPA), such as one sold under the name UNICLEAR, or PENRECO gel sold by Pennzoil. Paraffin waxes typically form a melt pool at between 150–200° F., while UNICLEAR polyamide forms a melt pool at between about 200–250° F. The capillary action can be through a fabric or thread wick or through a capillary tube. When the candle fuel pool becomes very shallow, it can become hot enough to vaporize and it no longer needs a wick to burn. This phenomenon is called "flash" or "flashover" and is a problem especially with candles formed or supported in containers.

Once the upper surface of the wax descends nearly to the floor of the container, the shallow pool of wax can be elevated above its flashpoint temperature, typically between 350–450° F. for conventional paraffin waxes and about 440° F. for UNICLEAR, for example. During flashover, the temperature within the candle can be elevated to at least 1200° F. This excessive heat can cause glass containers to break, and it can cause metal tins to scorch the paint off the tin sides and char surfaces on which they are resting. With freestanding candles the molten wax pool must not extend through the candle floor, because wax can flow out onto the candle supporting surface. If the wax flows out or the container of a contained candle breaks, supporting or surrounding objects can be ignited.

An additional problem is that carbon balls may form during burning and fall into the wax pool at the bottom of the candle, or the user may allow matches or wick trimmings to fall to the bottom. These foreign objects may aggravate the flashover problem by becoming secondary wicks if they are ignited by the candle flame.

In conventional candles formed in containers, a wick support like the sustainer 2 shown in FIG. 1, is often used to provide lateral support to a wick in a candle to hold the wick in place during pouring of the wax or other fuel. The sustainer 2 also keeps the wick standing upright when the supporting wax around the wick burns very low. The wick is held in a bore formed completely through the sustainer.

Sustainers of this type are popular for use in candles because they are easily assembled using machines. The wick is simply inserted through the bore and held in place by crimping the bore. The cylindrical plate of the sustainer 2 is easily affixed to a container for holding a candle.

During burning, molten wax 4 is drawn upwardly through the wick sides initially, and is carried to the flame. As the upper surface of the molten wax 4 descends to near the top end of the sustainer 2, the heat from the flame liquifies the wax all around the sustainer 2. Once this wax is liquified, molten wax 4 can be drawn from beneath the sustainer 2 through the bore and upwardly to the flame. This permits the majority of the wax 4 to be consumed before the flame goes out from lack of fuel. When the depth of the molten wax 4 is sufficiently small, the flashover problem can occur.

Flashover is a problem which causes significant damage and harm. Flashover can result in house fires and burns to people who use candles decoratively. This is a problem which is being given more attention by consumer groups and needs to be solved in an economical way. The need exists for an inexpensive and simple safety device for preventing or significantly decreasing the likelihood of flashover.

Several different approaches to solving the problem of flashover have been provided. U.S. Pat. No. 5,842,850, for example, discloses several embodiments of a wick sustainer of the type shown in FIG. 1 having the bottom end of the sustainer sealed against permeation by a candle fuel. The sealed bottom prevents molten candle fuel from being drawn through the wick in the bore of the wick sustainer, causing the candle to extinguish when the fuel level drops below the level of the exposed wick above the wick sustainer.

U.S. Pat. No. 4,332,548 teaches a transparent safety disc at the bottom of a candle. The safety disc is formed by a thermoplastic polyamide resin, combined with a flammable solvent for the resin that is compatible with the candle material. The candle is also transparent. A wick holder and wick are placed on a layer of the resin mixture followed by pouring the candle material around the wick and wick holder and over the resin layer. The safety disc layer helps prevent flameups due to its higher melting point and other characteristics which render it substantially non-flammable in the presence of a candle flame.

U.S. Pat. No. 3,797,990 discloses a safety layer for a candle formed from a higher melting point wax. The higher melting point wax in the safety layer is not combustible by a candle flame. The safety layer may be positioned around or below the wick clip and wick bottom. When the candle flame nears the safety layer and causes it to melt, the wax in the safety layer begins to block the wick, subsequently resulting in the candle flame being extinguished due to lack of fuel.

U.S. Pat. No. 2,831,330 teaches adding polybutene polymers to a candle wax in different proportions to first extend the burn time of the candle and then in an amount sufficient to extinguish the candle due to lack of fuel. Polybutene polymer provided in concentrations of about 15% in a portion of a candle is disclosed as being capable of extinguishing a candle when the candle flame reaches the area of higher polybutene concentration.

U.S. Pat. No. 5,127,922 describes a candle having an outer shell which includes 10–30% of a fire retardant material. The fire retardant material is mixed with a thermoplastic compound, so that the shell will slowly melt and mix with the candle fuel as the candle burns. The fire retardant can be a silicone elastomer, a non-halogenated, inorganic flame retardant or an alumina trihydrate, among other compounds.

Other mechanical devices for extinguishing a candle prior to the point where a flashover or flameup would occur are known, such as taught by U.S. Pat. No. 4,818,214 for a candle having a heat-shrinkable sleeve around the candle near the base. When the candle burns down sufficiently that the candle flame is near the sleeve, the heat activates the sleeve, causing it to shrink inwardly, constricting the wick and extinguishing the flame.

Several of the prior art devices and compounds use flame retardants or flame-resistant materials to extinguish the flame. But, the prior compounds and apparatus for preventing flashover or extinguishing a candle flame can be complex and require particular mixtures of components. Further, some prior art flame-retardant coatings and mixtures for use on wicks or in candle fuels can also make the candle difficult to use by extinguishing the candle prematurely and requiring relighting well before the end of the useable life.

Polyethylene discs with central bores for holding wicks have been suggested for use as the wick holder in a candle to prevent flashover. However, testing has revealed that polyethylene discs soften at 200° F. and can combust rather easily when exposed to a burning candle flame. Thus, polyethylene, while easy to mold, is not suitable for providing a non-combustible wick holder for extinguishing a candle flame at the end of the candle useful life.

Clearly, few simple solutions for preventing flashover which are easy to manufacture and incorporate into a candle are available.

A flame-resistant and retardant wick holder which can be easily incorporated into candles in place of existing wick sustainers is needed. Plastics are a material which can be easily molded and formed, but which can also combust and produce very toxic by-products.

A widely accepted test to determine flammability of plastics used in products is found in Underwriter Laboratories UL-94 standard. ASTM standard 3801-96 and ISO standard 1210-1991 are similar standards having similar tests and equivalent ratings.

The UL-94 standard includes horizontal and vertical burn tests which can be used to rate the flammability of plastics. The vertical burn test is considered more stringent and a plastic can receive one of several ratings, depending on its flammability.

A rating of V-0 from the UL-94 vertical burn test indicates that combustion of the product stops within ten seconds after two applications of ten seconds each of a flame to a test bar of the plastic material, and the material must not produce any flaming drips. The V-0 rating is considered the best rating of non-flammability for a plastic.

The UL-94 vertical burn test is performed by suspending a ½ inch wide by 5 inch long test rod of the plastic material over a cotton pad. A burner flame is applied to the lower end of the test rod for ten seconds, following which combustion of the rod, if any is observed until it stops. The burner flame is applied to the test rod for a second period of ten seconds. Observations of the test rod following application of the flame determine the rating the material will receive. In addition to the requirements noted above, the specimen must not begin glowing or flaming combustion after application of the burner flame. The rating for the material is based on the thickness of the test rod used. That is, a ¼ inch thick test rod which achieves a V-0 rating qualifies the material of the test rod used in products in ¼ or greater thicknesses. The thinner the test rod, the less combustible the material.

Polyethersulfone (PES) is one such material which has a V-0 rating for the UL-94 vertical burn test at a thickness of 0.8 mm, or about 1/32 inches. Polyethersulfone is a thermoplastic material which is commonly used for electrical applications such as wire insulation, connectors, molded interconnects and housings for starters. Polyethersulfone is also known for use in other applications as well where heat resistance is desired. However, while the combustion characteristics of polyethersulfone are known, PES is not known for use in applications involving open flames.

SUMMARY OF THE INVENTION

It is an object of the present invention to provide a non-combustible wick holder for a candle to eliminate flameover.

It is a further object of the invention to provide a wick holder which will extinguish a candle flame on a wick when the flame reaches the wick holder.

Yet another object of the invention is to provide a non-flammable wick holder that is easily incorporated into a candle supported in a container for preventing flashover of the candle when the wick burns down to the wick holder.

Accordingly, a flame-retardant wick holder for a candle wick is provided which effectively extinguishes the candle flame on the wick when the flame and fuel level reach the wick holder. The flame-retardant wick holder is a disc made of a polyethersulfone with a bore through the center for holding a candle wick. The top surface of the disc may be sloped away from the bore in the center, so that the top surface has a conical shape, or it may be flat.

The wick holder is sufficiently thick, or shaped to have a maximum height, so that the upper end of the bore is raised above the floor of the container where the disc is used to prevent candle fuel from melting and rising through the wick in the bore. The wick holder may have a diameter or width the same as the container it is used in, or it may be as small as about one inch across. The wick holder may be shaped to accommodate the shape of the container, or it is circular.

The polyethersulfone (PES) used to make the wick holder is selected from those having a UL-94 vertical burn test rating of at least V-0 or which is non-combustible and intumescent when heated. Other polymers which are also non-combustible and intumescent like polyethersulfone can be used to make the wick holder with similar effect.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
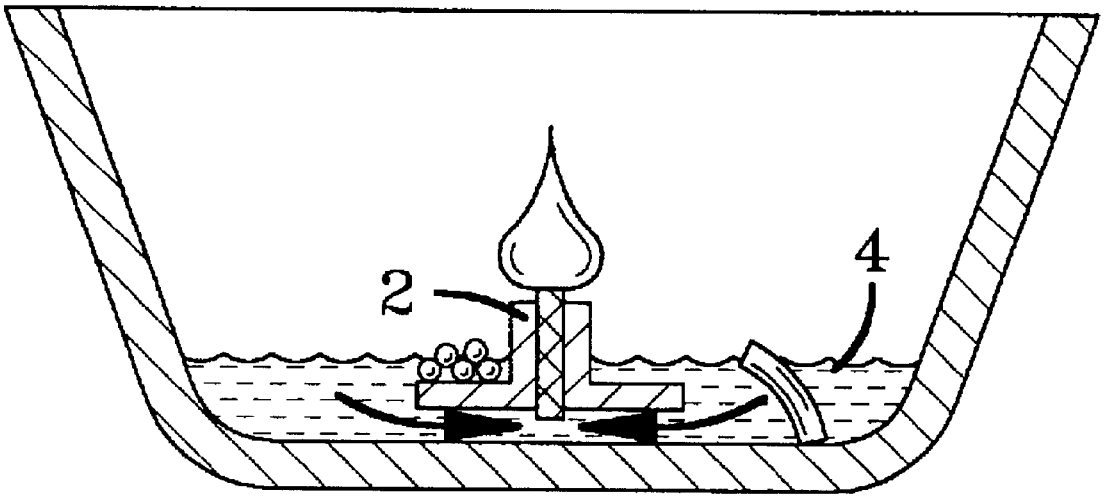
FIG-1 (PRIOR ART)
FIG. 1 is a side sectional view of a prior art candle and wick holder.
Figure 2:
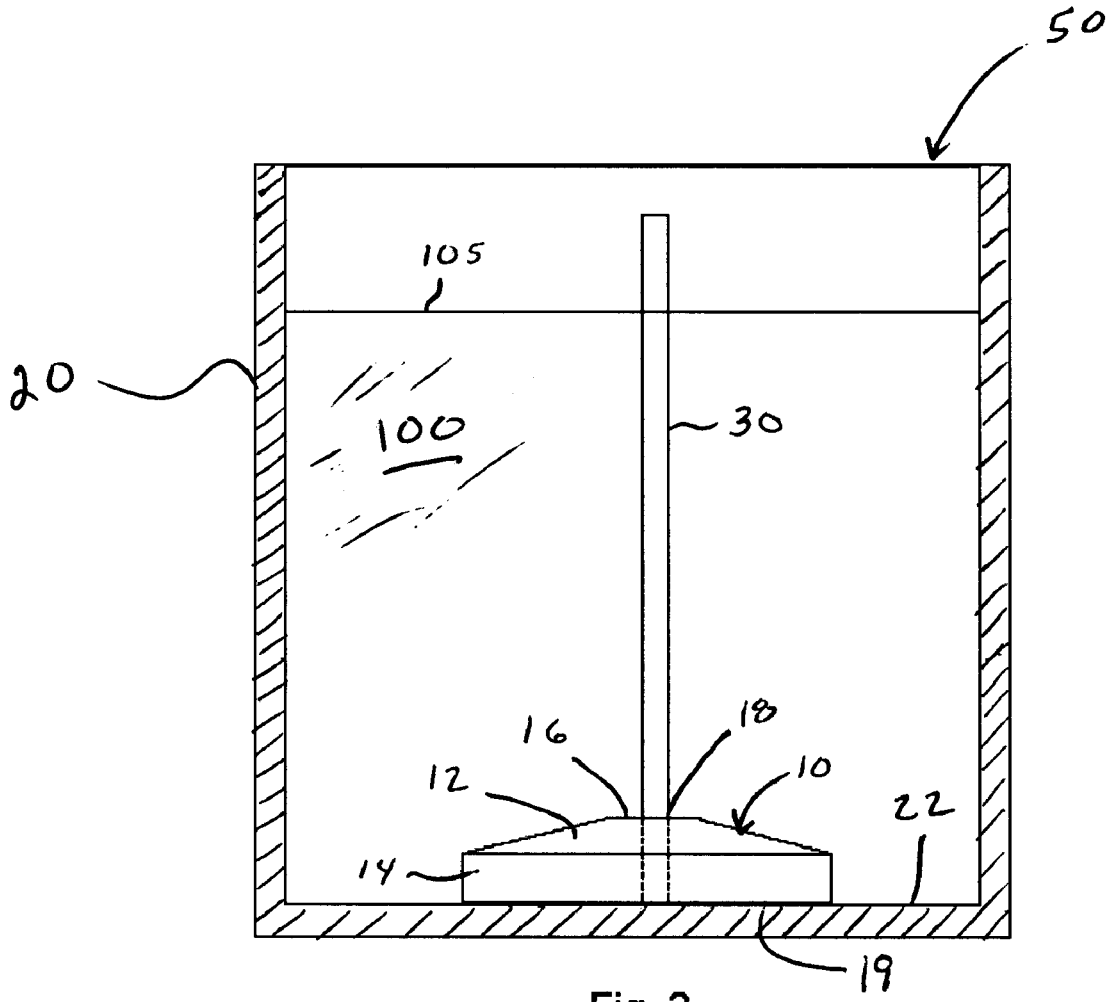
FIG. 2 is a partial sectional side elevation view of a candle having a wick holder according to the invention.

Referring now to the drawings, in which like reference numerals are used to refer to the same or similar elements, FIG. 2 shows a sectional view of a filled candle 50 formed by a container 20 holding candle fuel 100 around wick 30. Wick 30 extends through the candle fuel 100 from the fuel top surface 105 to the container floor 22. The lower end of the wick is inserted through bore 18 of a disc-shaped wick holder 10.

Figure 3:
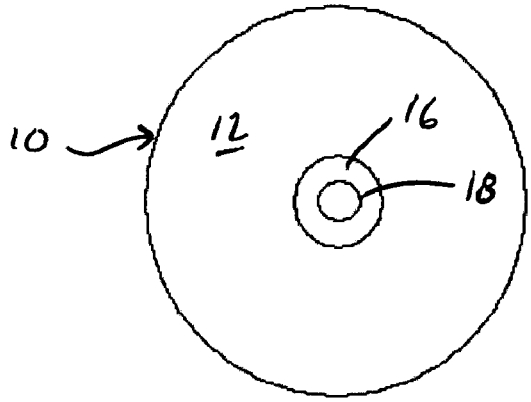
FIG. 3 is a top plan view of the wick holder of FIG. 2.

As seen in FIGS. 2 and 3, the wick holder 10 has a cylindrical base 14, a sloped upper surface 12 and a horizontal top surface 16. The bore 18 extends vertically through the wick holder 10 between the horizontal top surface 16 and the holder bottom 19. The wick 30 can be held within the bore 18, for example, by frictional fit between the wick 30 and bore 18 or by an adhesive, among other things.

The wick holder 10 preferably rests with the holder bottom 19 supported on container floor 22. In such cases, the candle 50 may be formed by inserting wick 30 through bore 18 and placing wick holder 10 on the floor 22 of the container 20. The wick holder 10 can be secured in place on the container floor 22, such as with a small amount of adhesive or a tacky candle fuel material. Then, liquid candle fuel 100 is poured into the container 20 around the wick holder 10 and wick 30 until the top surface 105 of the candle is at a desired level, and the wick 30 still protrudes from the top surface 105. The candle fuel 100 is allowed to solidify around the wick 30 in the container 20 before it is used by lighting the wick 30.

The wick holder is preferably made of a polyethersulfone, such as RADEL polyethersulfone sold by BP AMOCO. The polyethersulfone selected must have a UL-94 flammability test rating of at least V-0 or better. It has been found that polyethersulfone used for the wick holder 10 material causes a flame on a candle wick 30 to extinguish when the wick 30 and candle fuel 100 reach the horizontal top surface 16 of the wick holder 10. The polyethersulfone does not support sustained combustion, so the candle flame cannot be sustained when the wick 30 is deprived of candle fuel 100 by the presence of the wick holder 10.

The sloped upper surface 12, when present, may be formed at any angle between 0° and 90°. When the upper surface 12 is at 0° or 90° it is either merged into the horizontal top surface 16 or the vertical side of base 14, respectively. Similarly, the horizontal top surface 16 around bore 18 may be eliminated (see FIG. 8), so that the sloped upper surface 12 provides a conical shape to the top of the wick holder 10. The sloped surface 12 helps drain molten candle fuel 100 away from the wick 30 so that it cannot fuel the candle flame. Preferably, the sloped surface 12 is present and ranges between a 5° and 30° angle with a horizontal plane.

The polyethersulfone wick holder 10 acts as a heat sink as well, to disperse heat from the burning candle flame away from the area immediately around the candle flame to reduce the size of the molten fuel puddle produced when the flame is at or near the level of the wick holder.

FIGS. 4–9 illustrate alternate shapes for the wick holder 10.

Figure 4:
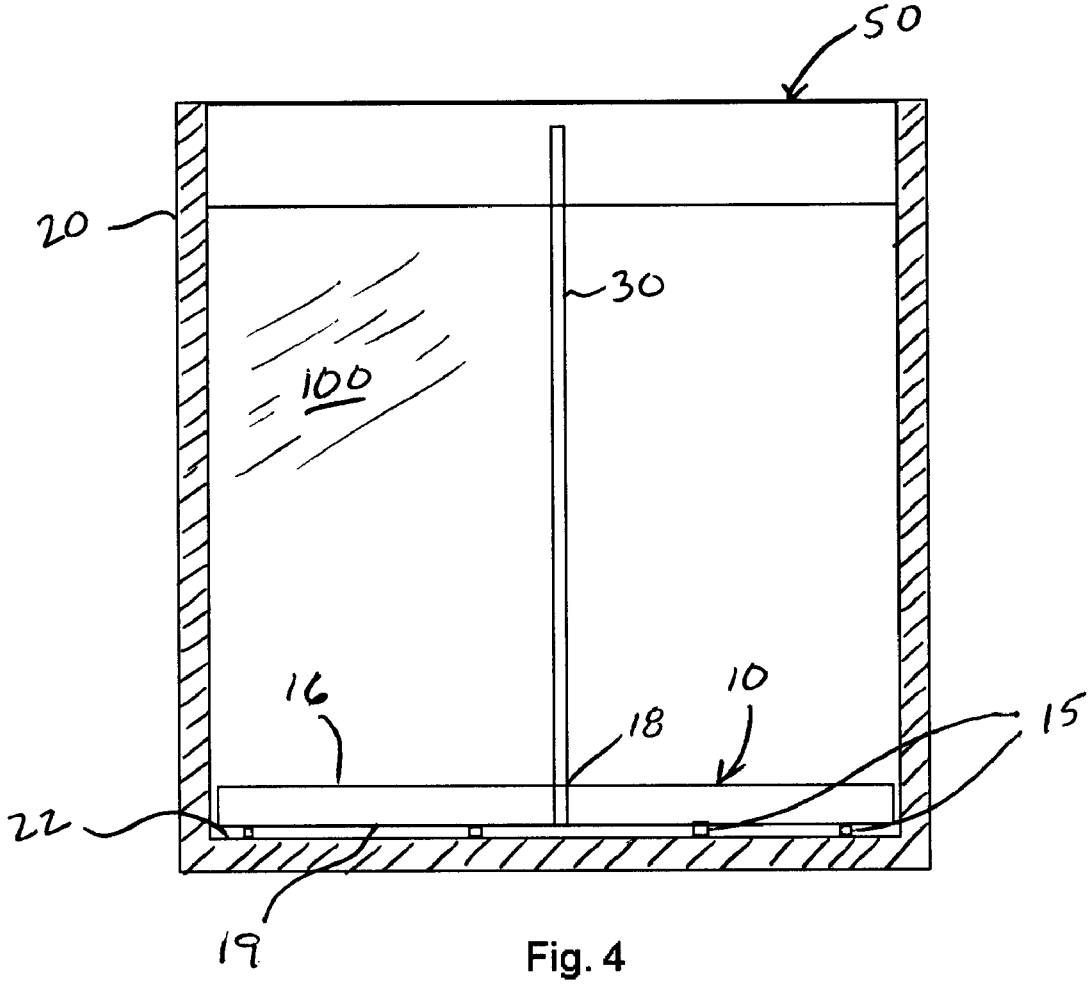
FIG. 4 is a partial sectional side elevation view of an alternative embodiment of the candle and wick holder of FIG. 2.
Figure 5:
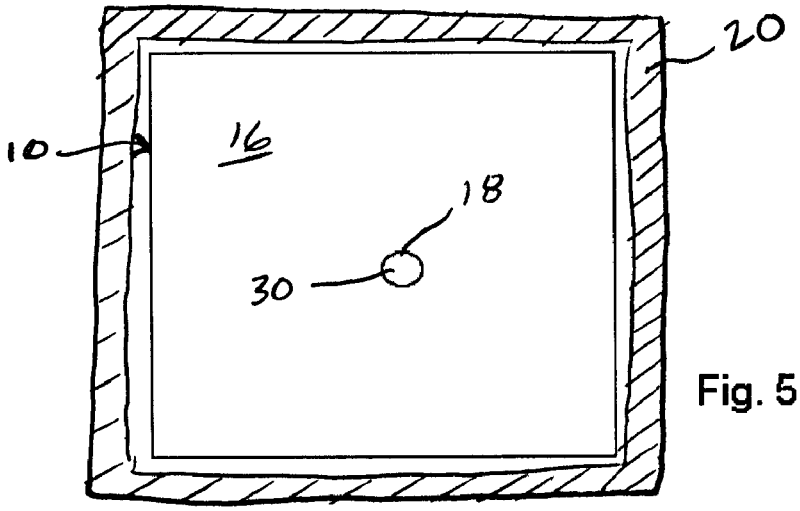
FIG. 5 is a sectional top plan view of the wick holder of FIG. 4.

The wick holder 10 in FIGS. 4 and 5 has a square shape with only a planar top surface 16. The wick holder 10 extends across substantially the entire width between the walls of the container 20. In this embodiment, the container 20 has a square shape and the wick holder 10 is square as well to conform to the container 20 shape. The wick holder 10 has several legs 15 on which bottom surface 19 can be supported above the floor 22 of the container. Bore 18 is preferably provided in about the center of the wick holder 10.

Figure 6:
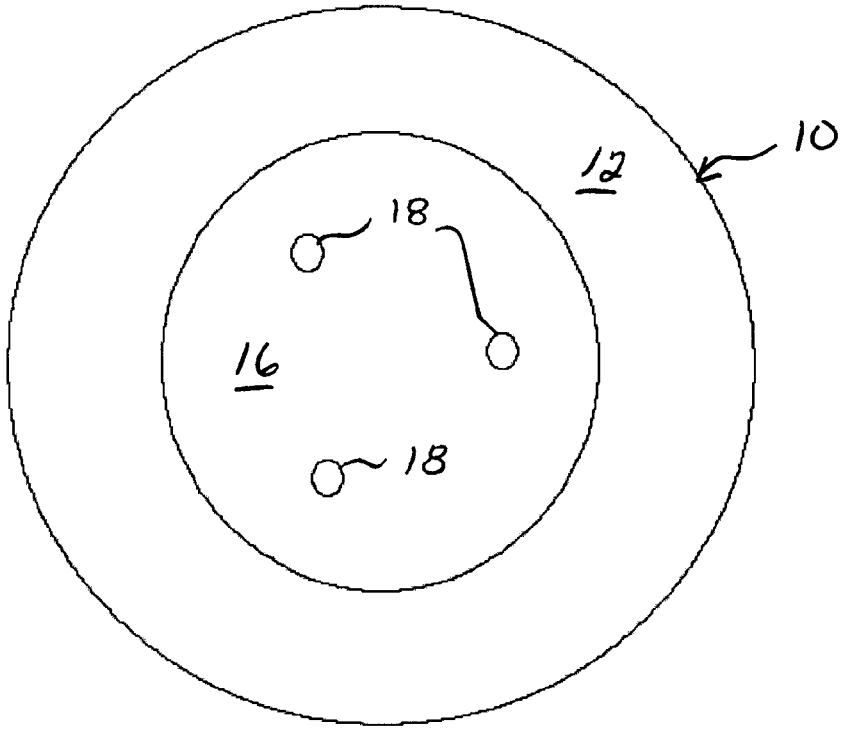
FIG. 6 is a top plan view of yet another embodiment of a candle and wick holder of the invention.
Figure 7:
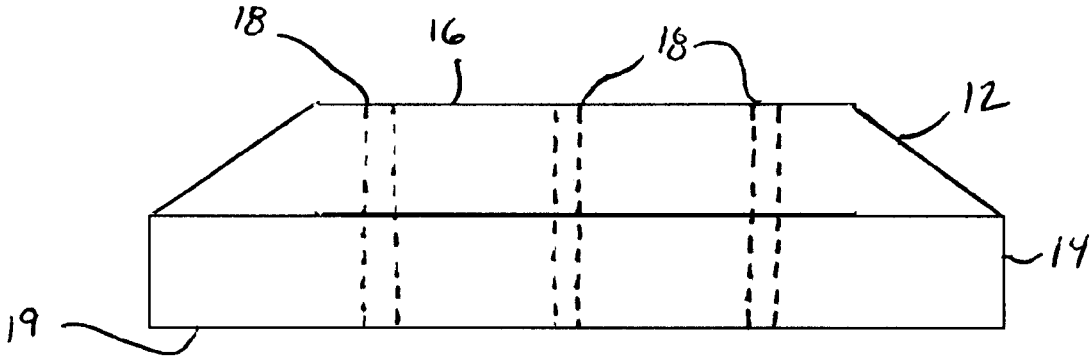
FIG. 7 is a side elevation view of the wick holder of FIG. 6.

FIGS. 6 and 7 illustrate an embodiment of the wick holder 10 for use with multiple-wick candles. The wick holder has three bores 18 for each holding a separate wick. The bores 18 are spaced around the horizontal upper surface 16 to define a triangle. The wick holder 10 has a sloped upper surface 12 around the horizontal top surface 16.

Figure 8:
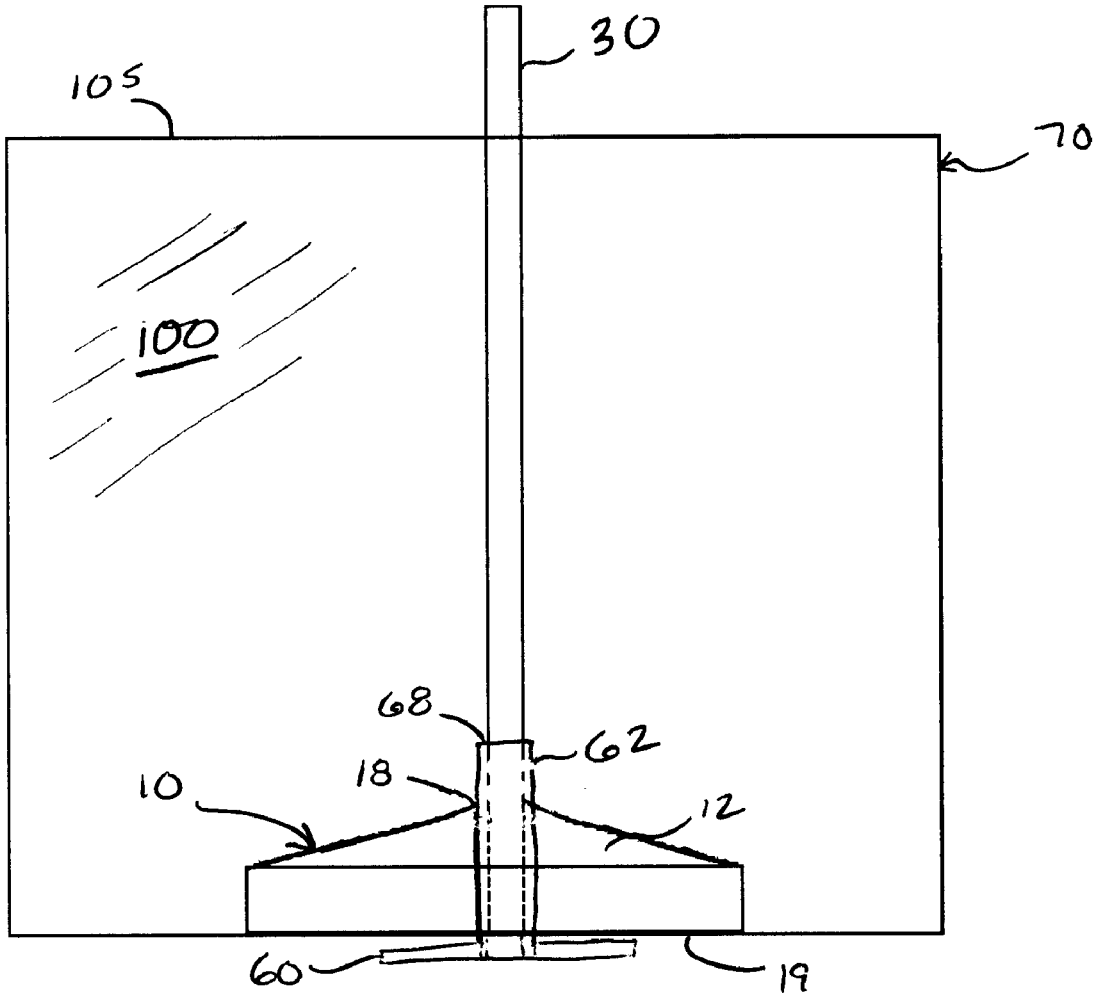
FIG. 8 is a partial sectional side elevation view of a pillar candle with a further embodiment of a wick holder according to the invention.

FIG. 8 shows a pillar candle 70 made from candle fuel 100 and having a wick 30 extending above candle top surface 105. The wick 30 extends downwardly through the candle fuel 100 where it is secured in a wick clip 60 inserted through the bore 18 of wick holder 10. The wick clip 60 may be of the type used in prior art candles to hold the wick in place. The wick 30 is crimped into tube 62, which defines clip bore 68 surrounding wick 30. The base of the wick clip 60 may be exposed outside the candle fuel 100 or slightly encased within the fuel 100 against the holder bottom 19.

Figure 9:
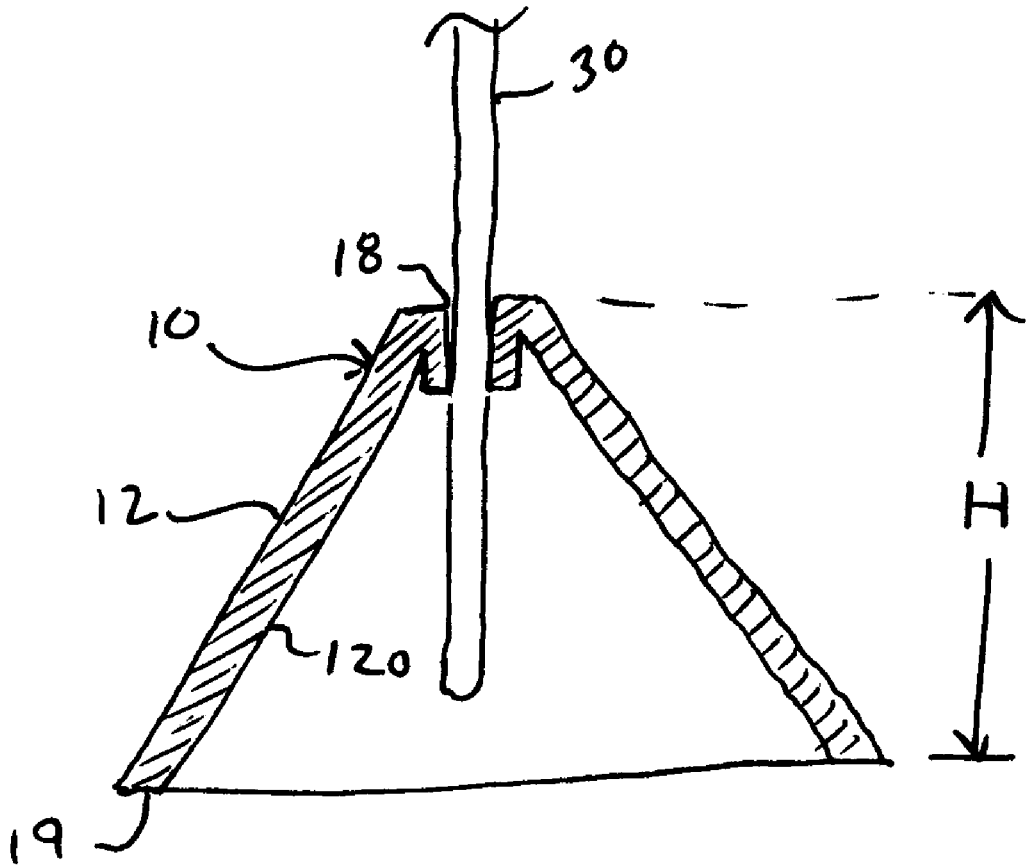
FIG. 9 is a sectional side elevation view of yet another embodiment of the wick holder of the invention.

FIG. 9 illustrates an embodiment of the wick holder 10 which is formed as a hollow cone or cap. The outer sides of the wick holder are formed by sloped surface 12, which taper from the bottom edge surface 19 to the bore 18 at the top. Since the holder 10 is hollow, a corresponding inner sloped side 120 is formed opposite the sloped surface 12. A wick 30 is inserted through bore 18 and held by a frictional fit or adhesive. When the wick holder 10 is a hollow cone as shown in FIG. 9, it is very easy to make by injection molding using polyethersulfone.

The cone-shaped holder of FIG. 9 is preferably at least about ½ inch in diameter at bottom edge surface 19 and most preferably at least about 1 inch in diameter or greater. The height H of the wick holder 10 should be at least about ⅛ inch, and is preferably between about ¼ inch and 1 inch. The thickness of the holder 10 between sloped surface 12 and inner sloped side 120 should be at least about 1/32 inch or greater.

Polyethersulfone (PES) is a preferred material for making the wick holder 10 for several reasons. PES is a thermoplastic capable of withstanding elevated temperatures. This characteristic allows PES to be easily molded using injection molding techniques. PES is resistant to acids, bases, aliphatic hydrocarbons, oils and fat, among other things, so that it is unlikely to absorb fragrance oils or candle fuels which might make the wick holder 10 somewhat combustible. Polyethersulfone melts at about 230° C. (about 446° F.). It has a Vicat softening point of about 215° C. (419° F.). A very favorable feature of polyethersulfone is that it is intumescent. That is, when PES is heated, such as by a candle flame, it begins to swell, which in the region of the bore 18, acts to cut off the capillary action in the wick.

Further, PES can appear transparent to yellowish, so that it is usable in transparent candles.

PES is substantially non-combustible, having a UL-94 standard vertical burn test rating of V-0. The resistance to combustion of PES combined with heat dissipation properties of a sufficiently large wick holder 10 results in a wick holder according to the invention being capable of extinguishing a candle flame when the flame reaches the level of the wick holder upper surface.

Several tests were conducted with different size wick holders made from PES in accordance with the invention to verify the ability of the wick holders to extinguish a candle flame. The test samples and results were as follows.

TEST 1

Three cylindrical paraffin wax candles and three cylindrical candles made from UNICLEAR each having a PES wick holder ⅜ inches in total height, with a 10° slope to the sloped upper surface 12, 3/32 inch diameter bore 18 and one inch diameter across were provided. The candles were burned 12 hours per day until the candle was at the end of its useful life. The candles were each monitored to determine if they extinguished on their own at the end of the candle useful life. In particular, the candles were monitored to determine if they self-extinguished once the top surface of the PES wick holder 10 was exposed, or alternatively, if secondary wicking occurred, such as from carbon ball buildup or wick pieces in the residual candle fuel. It was observed that all six candles extinguished upon reaching the PES wick holder, despite the presence of carbon balls adjacent the wick. The width of the PES wick holder prevented wick pieces from causing any secondary wicking.

TEST 2

Three cylindrical paraffin wax candles and three cylindrical candles made from UNICLEAR each having a PES wick holder ⅜ inches in total height, with a 10° slope to the sloped upper surface 12, 5/32 inch diameter bore 18 and one inch diameter across were provided. The candles were burned and observed as in Test 1, above. Again, all six candles self-extinguished despite the presence of carbon balls and some small wick pieces which were trapped on the sloped upper surface of the wick holder and prevented from igniting any candle fuel. The PES holder did not experience any combustion.

TEST 3

Three cylindrical paraffin wax candles and three cylindrical candles made from UNICLEAR each having a PES wick holder ⅜ inches in total height, with a 20° slope to the sloped upper surface 12, 3/32 inch diameter bore 18 and one inch diameter across were provided. The candles were burned and observed as in Test 1, above. All six candles self-extinguished.

TEST 4

Three cylindrical paraffin wax candles and three cylindrical candles made from UNICLEAR each having a PES wick holder ⅜ inches in total height, with a 20° slope to the sloped upper surface 12, 5/32 inch diameter bore 18 and one inch diameter across were provided. The candles were burned and observed as in Test 1, above. All six candles self-extinguished.

TEST 5

Three cylindrical paraffin wax candles and nine cylindrical candles made from UNICLEAR each having a PES wick holder ¼ inches in total height, with a 10° slope to the sloped upper surface 12, 5/32 inch diameter bore 18 and one inch diameter across were provided. The candles were burned and observed as in Test 1, above. All but one of the candles self-extinguished despite the presence of carbon balls and wick pieces.

TEST 6

Three cylindrical paraffin wax candles and three cylindrical candles made from UNICLEAR each having a PES wick holder ¼ inches in total height, with a 20° slope to the sloped upper surface 12, 3/32 inch diameter bore 18 and one inch diameter across were provided. The candles were burned and observed as in Test 1, above. All six candles self-extinguished.

TEST 7

Three cylindrical paraffin wax candles and two cylindrical candles made from UNICLEAR each having a PES wick holder ¼ inches in total height, with a 20° slope to the sloped upper surface 12, 5/32 inch diameter bore 18 and one inch diameter across were provided. The candles were burned and observed as in Test 1, above. All five candles self-extinguished.

In each of the tests above, a 44-32-18c wick from Atkins and Pierce was used.

As shown by the tests, a relatively small wick holder 10 incorporated into a candle can provide a self-extinguishing feature. Preferably, the wick holders 10 will be at least 1 inch in diameter, up to the diameter of the container or candle the wick holder is used with. The wick holders can be between 1/32 inch thick to 1 inch or more, but are preferably about 3/32 to ½ inch thick between the bottom surface 19 and horizontal top surface 16 or top opening of the bore 18 when there is no top surface 16. The wick holders 10 should position the top opening of the bore 18 at about ⅛ inch above the bottom of the candle or container bottom 22, and preferably between about ¼ inch and 1 inch above the container bottom 22 or candle bottom.

Other polymers having similar properties to PES can be used for the wick holder 10. In particular, the polymer must not support combustion by a candle flame. Polymers which have at least a V-0 rating from the UL-94 test are good candidates. Preferably, the polymer will also be intumescent when heated, so that the same constriction effect in the bore 18 is provided when the candle flame reaches the top surface 16 of the wick holder 10. Acceptable polymers include polyphenylsulfones (PPS) and polyvinylchloride (PVC) which meet the non-combustion and intumescent requirements, will not melt at temperatures less than about 350° F. and can also be easily injection molded.

While a specific embodiment of the invention has been shown and described in detail to illustrate the application of the principles of the invention, it will be understood that the invention may be embodied otherwise without departing from such principles.

What is claimed is:

1. A wick holder for a candle having a wick, the candle mad from a fuel capable of melting to form a liquid pool and traveling by capillary action to a flame burning on the wick, the wick holder comprising a body having a top surface, a bottom surface, and a cylindrical bore for receiving the wick passing through the body between the top and bottom surfaces, the body around an opening of the bore in the top surface downwardly toward a side edge of the disk, the body made from a non-combustible, intumenscent polymer, and the body extinguishing the flame burning on the wick when the flame reaches the top surface of the body.

2. A wick holder according to claim 1, wherein the polymer is selected from the group consisting of polyethersulfones, polyphenylsulfones and polyvinylchloride.

3. A wick holder according to claim 1, wherein the non-combustible, intumescent polymer is a polyethersulfone.

4. A wick holder according to claim 1, further comprising a plurality of spaced apart feet extending from the bottom surface of the disk.

5. A wick holder according to claim 1, wherein the body forming the disk is a hollow cone having an inner sloped surface between a lower opening of the bore and the bottom surface, whereby the inner sloped surface corresponding to the sloped upper surface.

6. A self-extinguishing candle, comprising:

a body having a top surface, a bottom surface, and a cylindrical bore passing through the body between the top and bottom surfaces, the body being formed as a disk with a sloped upper surface extending from around an opening of the bore in the top surface downwardly toward a side edge of the disk, the body made from a non-combustible, intumescent polymer;

a candle fuel surrounding the body;

a wick inserted through the bore and extending through the candle fuel so that at least a portion of the wick is exposed above the candle fuel for lighting to melt the candle fuel adjacent the wick, the body extinguishing a flame burning on the wick when the flame reaches the top surface of the body.

7. A self-extinguishing candle according to claim 6, wherein the polymer is selected from the group consisting of polyethersulfones, polyphenylsulfones and polyvinylchloride.

8. A self-extinguishing candle according to claim 6, further comprising a plurality of spaced apart feet extending from the bottom surface of the disk.

9. A self-extinguishing candle according to claim 6, further comprising a container holding the candle fuel, the body resting on a floor of the container.

10. A self-extinguishing candle according to claim 9, wherein the polymer is polyethersulfone.

11. A self-extinguishing candle according to claim 6, wherein the body forming the disk is a hollow cone having an inner sloped surface between a lower opening of the bore and the bottom surface, whereby the inner sloped surface corresponding to the sloped upper surface.

* * * * *

UNITED STATES PATENT AND TRADEMARK OFFICE

CERTIFICATE OF CORRECTION

PATENT NO. : 6,508,644 B1 
DATED : January 21, 2003
INVENTOR(S) : Bradley D. Pesu and Joseph P. Romano It is certified that error appears in the above-identified patent and that said Letters Patent is hereby corrected as shown below:

Column 8,
Line 40, change "mad" to -- made --; and
Line 45, after "the body", insert -- being formed as a disk with a sloped upper surface extending from --.

Signed and Sealed this

Third Day of June, 2003

JAMES E. ROGAN
*Director of the United States Patent and Trademark Office*